United States Patent [19]

Shaw

[11] Patent Number: 5,031,258

[45] Date of Patent: Jul. 16, 1991

[54] WASH STATION AND METHOD OF OPERATION

[75] Inventor: Daniel C. Shaw, Geneva, Fla.

[73] Assignee: Bauer Industries Inc., Orlando, Fla.

[21] Appl. No.: 378,921

[22] Filed: Jul. 12, 1989

[51] Int. Cl.[5] ..... E03C 1/05

[52] U.S. Cl. ..... 4/623; 4/304; 4/624; 4/DIG. 3; 4/664; 251/129.04; 242/55.53

[58] Field of Search ..... 4/623, 191, 628, 624, 4/302-305, DIG. 3, 313, 314, 664; 251/129.02, 129.03, 129.04; 242/55.53

[56] References Cited

U.S. PATENT DOCUMENTS

| | | | |
|---|---|---|---|
| 2,975,719 | 3/1961 | Kaufman | 417/477 |
| 3,576,277 | 4/1971 | Blackman | 4/623 |
| 3,582,234 | 6/1971 | Isreeli | 138/45 X |
| 3,639,920 | 2/1972 | Griffin et al. | 4/623 |
| 3,756,752 | 9/1973 | Stenner | 417/477 X |
| 4,145,769 | 3/1979 | MacFairlane et al. | 4/DIG. 3 |
| 4,336,619 | 6/1982 | Hinkel et al. | 4/628 |
| 4,398,310 | 8/1983 | Lienhard | 4/623 |
| 4,606,085 | 8/1986 | Davies | 4/623 |
| 4,666,099 | 5/1987 | Hoffman et al. | 242/55.53 |
| 4,742,583 | 5/1988 | Yoshida et al. | 4/623 X |

*Primary Examiner*—Henry K. Artis

*Attorney, Agent, or Firm*—Shlesinger Arkwright Garvey

[57] ABSTRACT

A wash station comprises a sink and a faucet. A source of water and a source of soap are provided. An electrically operated valve is interposed between the water source and the faucet for selectively supplying water thereto, and a pump and valve are interposed between the soap source and the faucet for selectively supplying soap thereto. An electrically operated roll towel dispenser is disposed proximate the sink. A first infrared sensor is operably associated with the sink for determining the presence of a user. A control mechanism is operatively associated with the valves, the pump, the roll towel dispenser and the sensor for causing water and soap to be selectively supplied to the faucet and for thereafter causing a length of roll towel to be dispensed.

28 Claims, 6 Drawing Sheets

W1

FIG. 11
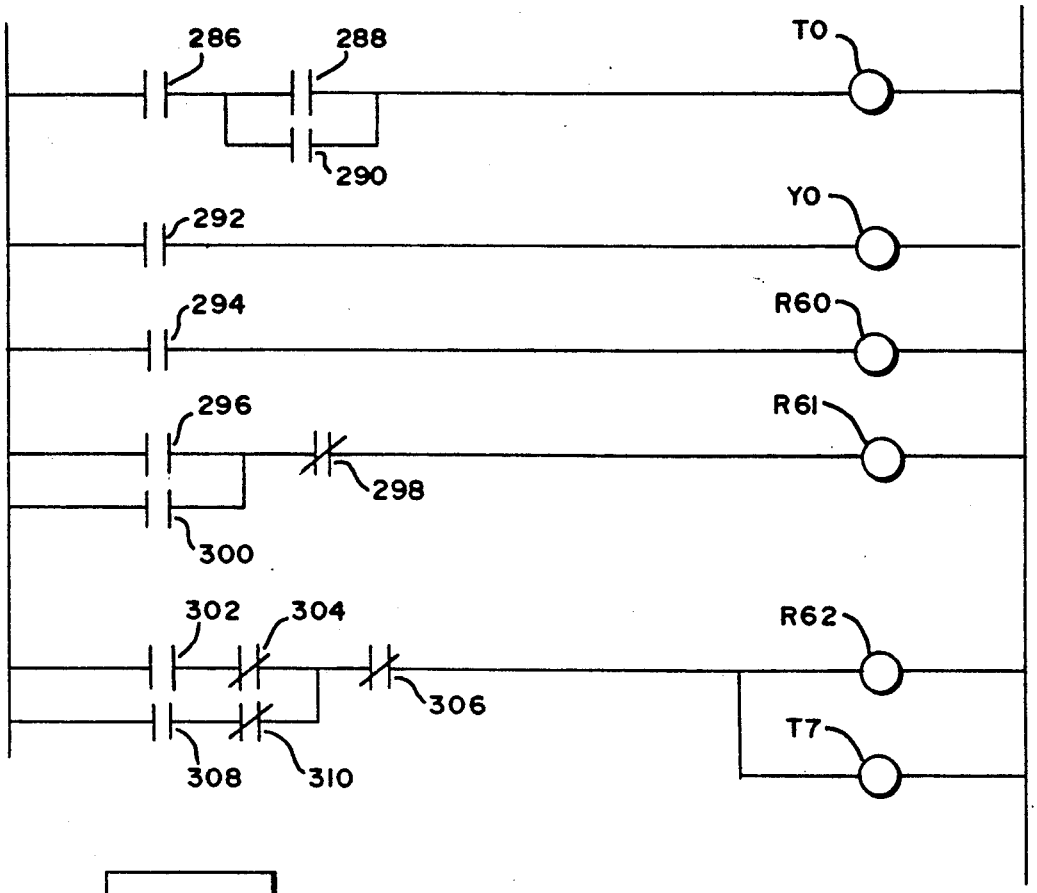
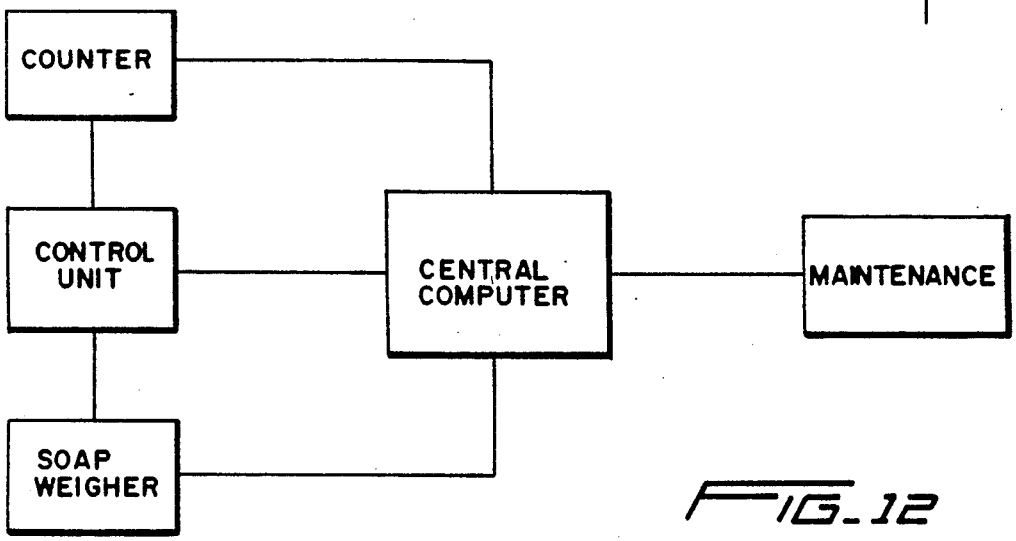
FIG. 12

WASH STATION AND METHOD OF OPERATION

BACKGROUND OF THE INVENTION

Many diseases are spread from one person to another through contact, whether direct or indirect. Direct contact causes the contagium to be transmitted from the carrier to another, who may become infected and/or pass the contagium on to yet another. Nosocomical infections are particularly prevalent with medical personnel, who may come into contact, knowingly or not, with infectious diseases. Indirect contact occurs when the carrier touches some article, thereby depositing the contagium and permitting it to be contacted by another coming into contact with the article. Many contagia are spread by contact, directly or indirectly with the hands.

Some contagia can be destroyed through the use of water and cleansing agents, such as soaps, antiseptic agents and the like. Hospital personnel may receive training in the proper method of washing hands, as a means for minimizing the spread of nosocomical infections. Many communities likewise require that individuals handling food wash their hands prior to handling food.

Many hospitals have a wash station which is utilized for the washing of hands. The wash station has a valve, possibly foot or leg operated, for controlling water flow from a faucet to a sink. A source of cleansing agent, such as a liquid soap, is also provided, as are folded paper towels for drying the hands. Hot air dryers are normally not provided in a hospital environment, because the flow of air has a tendency to spread the contagia. Wash stations suffer from numerous drawbacks, such as improper quantity of soap, a need to touch a valve or other potentially contaminated site after the hands are washed, and excessive use of water while the washing operation takes place.

The disclosed invention is a wash station, suitable for both hospital and food-handling establishments. The wash station has an infrared sensor for detecting the presence of a user. Once a potential user is detected, then a control system causes a sufficient quantity of water to be dispensed in order to permit the hands to be wet. A predetermined amount of soap sufficient to cleanse the hands is then dispensed, and a further quantity of water is dispensed in order to permit the hands to be rinsed. Finally, a selected length of roll toweling is dispensed.

Should the user merely desire to run the water, such as to obtain a drink, or to obtain some toweling, then the control system has means to permit these to occur, thereby by-passing the handwashing mode. Operation of the wash station may be monitored by a central computer, which also has the capability of notifying appropriate maintenance personnel if the wash station is not operating properly, or requires servicing.

OBJECTS AND SUMMARY OF THE INVENTION

The primary object of the disclosed invention is to provide a wash station suitable for hospitals and food-handling establishments as a means for minimizing the spread of infectious disease.

A further object of the disclosed invention is to provide a method of operating a wash station which minimizes the risk of infectious disease being spread.

A wash station, pursuant to the invention, comprises receptacle means for receiving fluids. A source of water is provided, as is a source of cleansing means. First means are interposed between the water source and the receptacle means for selectively supplying water thereto, and second means are interposed between the cleansing means source and the receptacle means for selectively supplying cleansing means thereto. A source of continuous roll towel means is disposed proximate the receptacle means. A first sensor means is operatively associated with the receptacle means for determining the presence of a user, and control means are operatively associated with the first and second means, with the roll towel means source, and with the sensor means for causing the selective supply of water and cleansing means to the receptacle means, and for thereafter causing a length of roll towel means to be dispensed.

A wash station comprises a support assembly having a lower cabinet with an interior and an upper vertical structure. A motor operated roll towel dispenser is mounted to the upper member, and a roll of toweling is operatively disposed within the dispenser. A sink is mounted to the cabinet below the dispenser, and a faucet means is mounted to the cabinet and extends over the sink. The faucet means has first and second flow channels discharging into the sink. A source of water is provided within the cabinet, as is a supply of soap. First means interconnect the source and one of the flow channels for permitting water to selectively flow to the faucet means, and second means interconnect the supply and the other of said flow channels for causing soap to be supplied to the faucet means. Sensor means are operatively associated with the assembly for detecting the presence of a user. Control means are operably connected to the dispenser, to the first and second means, and to the sensor means for causing soap and water to be selectively supplied to the faucet means and for thereafter causing a length of toweling to be dispensed.

The method of operating a wash station comprises the steps of determining the presence of a user. A predetermined volume of water is dispensed, after which a predetermined volume of soap is dispensed while the water is prohibited from being further dispensed. After an elapsed time, a predetermined volume of water is again dispensed, after which a predetermined length of roll toweling is dispensed.

These and other objects and advantages of the invention will be readily apparent in view of the following description and drawings of the above described invention.

DESCRIPTION OF THE DRAWINGS

The above and other objects and advantages and novel features of the present invention will become apparent from the following detailed description of the preferred embodiment of the invention illustrated in the accompanying drawings, wherein:

FIGS. 10 and 11 are schematic wiring diagrams of the embodiment of FIG. 9; and,

FIG. 12 is a schematic diagram illustrating the wash station control system.

DETAILED DESCRIPTION OF THE INVENTION

Figure 1:
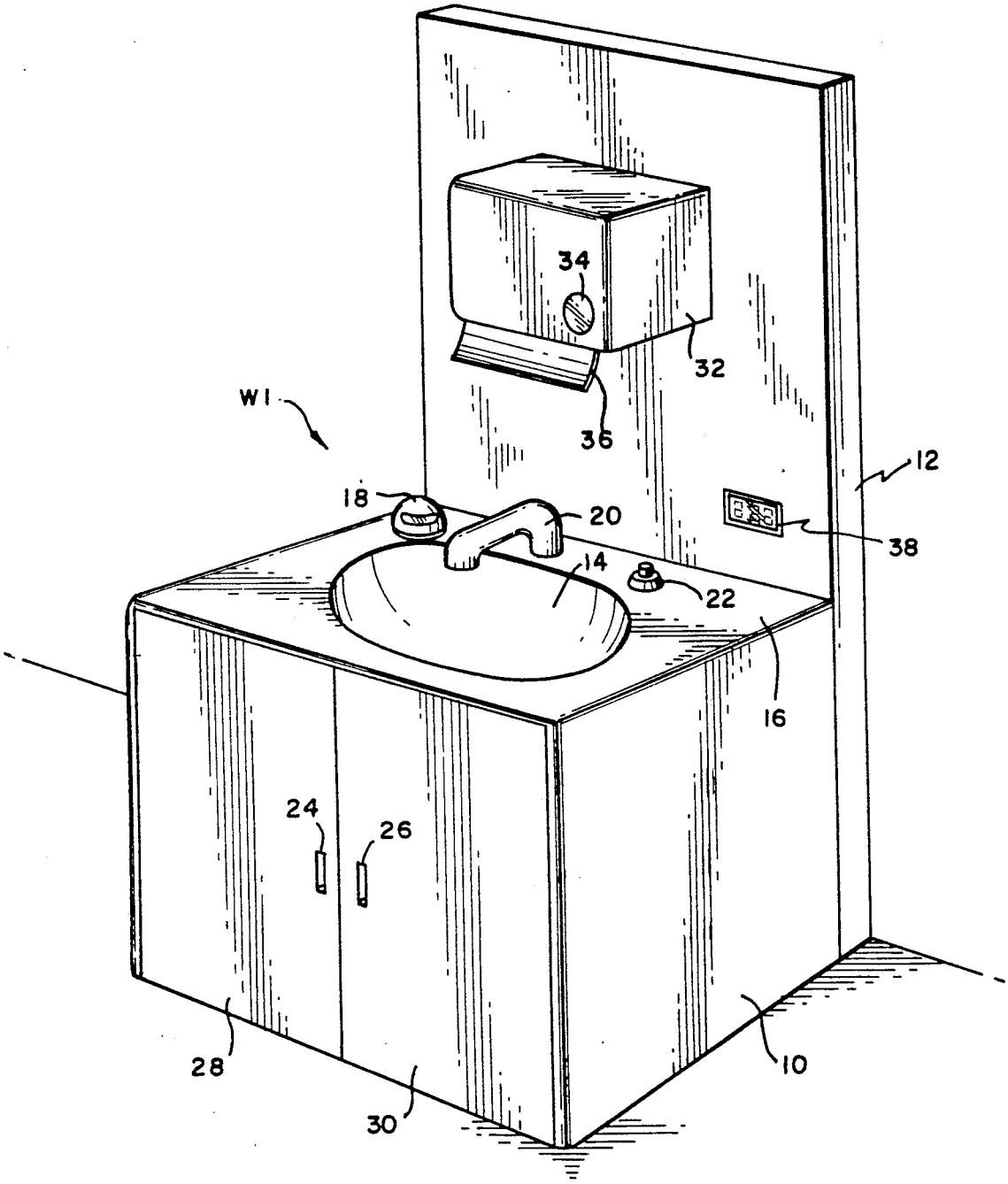
FIG. 1 is a perspective view of a first embodiment of the wash station of the invention.

Wash station W1, as best shown in FIG. 1, has a cabinet 10 and a vertical support 12. The cabinet 10 and support 12 may, as shown, be separate structural elements, or they may be integral or the support 12 might be part of a wall or the like. Also, while I prefer that the cabinet 10 and vertical support 12 be manufactured from stainless steel, those skilled in the art will understand that other compositions might be appropriate, such as when wash station W1 is in a restaurant environment.

Sink 14 is mounted to top 16 of cabinet 10. Also mounted to top 16 is an infrared sensor 18, a faucet 20 and a selector switch 22. Cabinet 10 may have handles 24 and 26, permitting doors 28 and 30 to be opened.

An electrically operated roll towel dispensing means 32 is mounted to vertical support 12. Roll towel dispensing means 32 is, preferably, manufactured pursuant to copending application Ser. No. 324,092, filed Mar. 16, 1989 by Albert H. Bauer and Daniel C. Shaw for APPARATUS AND METHOD FOR DISPENSING and now Pat. No. 4,960,248, the disclosure of which is incorporated herein by reference and the assignee of which is also the assignee of the present application. Dispensing means 32 has an infrared sensor 34, which preferably is a passive infrared detector, as compared with the active infrared detector of the sensor 18. Also disclosed in FIG. 1 is a length of toweling 36 extending from dispensing means 32, as well as display 38 which visually indicates the number of uses of wash station W1. While I prefer the use of paper towels, it is merely necessary that a continuous length of tearable drying material be dispensed from dispenser 32. Folded towels are not to be used, because they run the risk of contact with the possibly contaminated dispenser.

Figures 2, 3:
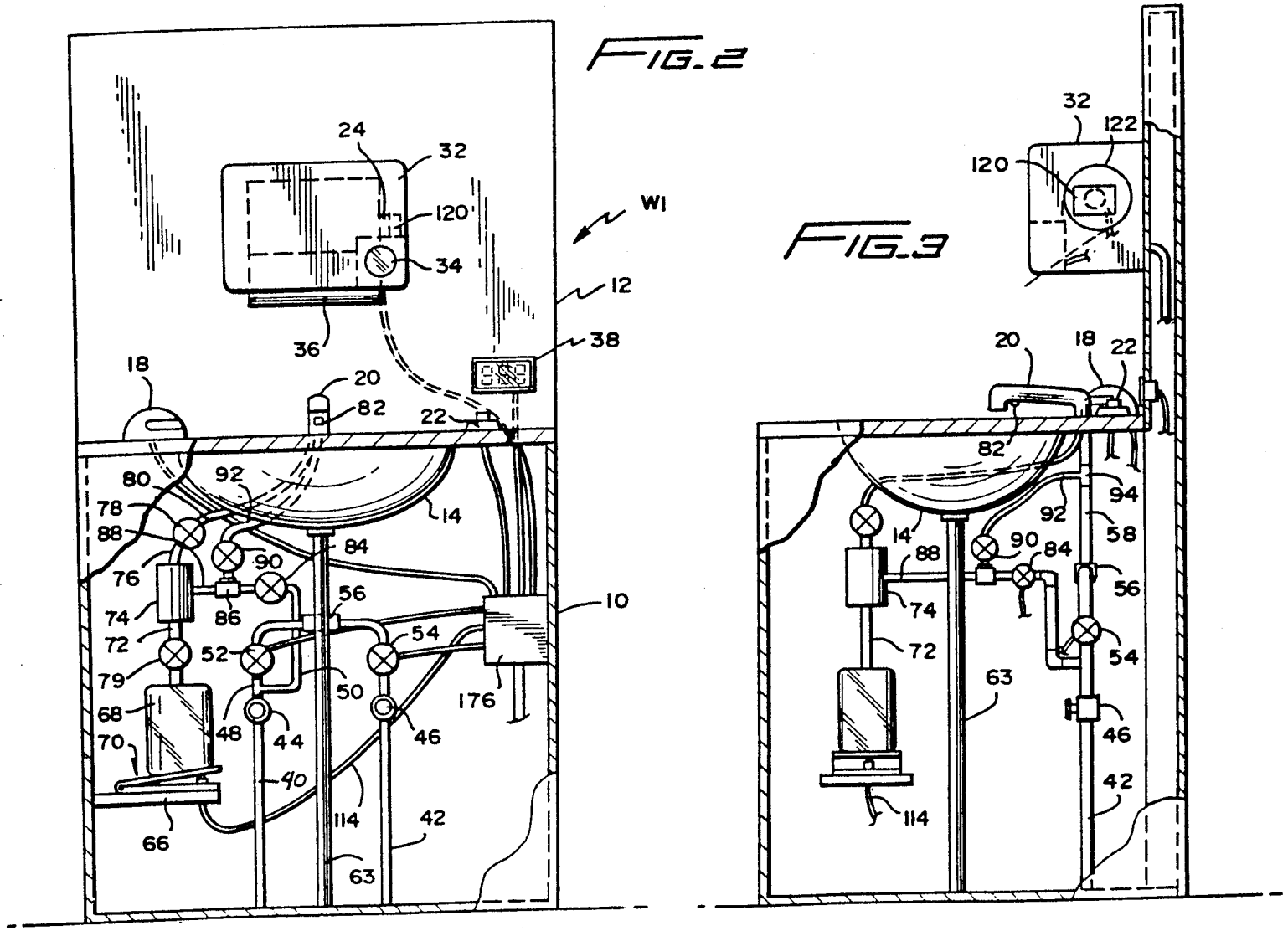
FIG. 2 is a front elevational view thereof, with portions shown in section and broken away.
FIG. 3 is a side elevational view thereof, with portions broken away and in section.
Figure 7:
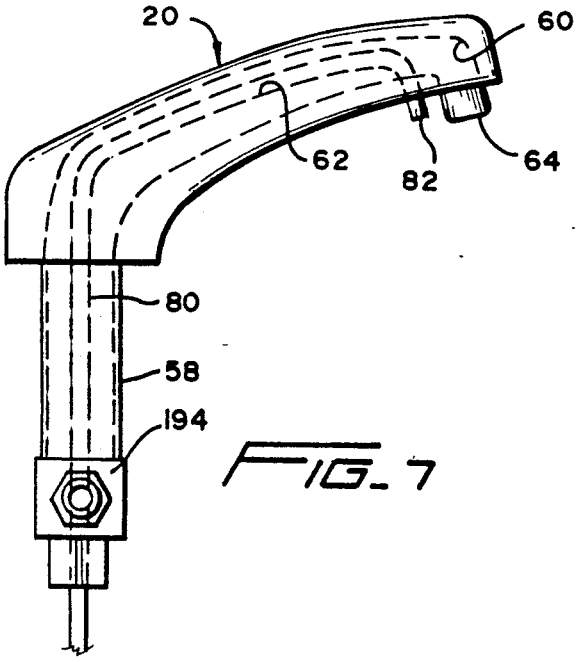
FIG. 7 is a fragmentary elevational view of the faucet of the invention.

As best shown in FIG. 2, cabinet 10 has an open interior in which appropriate operating elements of wash station W1 are located. Hot and cold water sources 40 and 42, are fed from the customary sources provided in most buildings. Manual shut-off valves 44 and 46 are disposed at the upper ends of water lines 40 and 42. A T-connector or fitting 48 extends from the water line above valve 44 and has line 50 extending therefrom, for reasons to be explained. Electrically operated solenoid valves 52 and 54 are interposed between valves 44 and 46, respectively, and T-connector 56. Line 58, as best shown in FIG. 3, leads from T-connector 56 to faucet 20 in order to supply water thereto when the normally closed valves 52 and/or 54 are in the open or flow permitting position. The T-connector 56 permits the hot and cold water to be mixed, in order to achieve a desired temperature. Faucet 20, as best shown in FIG. 7 has a water flow channel 60 and an interior soap flow channel 62, as will be further described. Water channel 60 terminates in nozzle 64 for directing the water into sink or water-receiving receptacle 14. Naturally, sink 14 has drain line 63 for directing drain water to a sewer or treatment system.

Horizontal support 66 is mounted within cabinet 10, and supports soap container or bottle 68 disposed on weigh apparatus 70. Line 72 leads from soap container 68 to pinch valve pump 74. Line 76 leads from pump 74 to check valve 78, while line 80 leads from check valve 78 to soap channel 62 of faucet 20. Check valve 79 is positioned in line 72 intermediate container 68 and pump 74. Soap channel 62, as best shown in FIG. 7, has a short length of tubing 82 extending from faucet 20 for directing soap into sink 14.

Solenoid operated control valve 84 is upstream in line 50 and leads to T-connector 86. Line 88 extends from T-connector 86 to the inlet of pinch valve pump 74 in order to provide pressurizing water thereto. The other outlet of T-connector 86 leads to control valve 90, which may be yet a further solenoid control valve or simply a restrictive orifice. Line 92 extend from control valve 90 to T-connector 94 of line 58, as best shown in FIG. 3.

Figure 4:
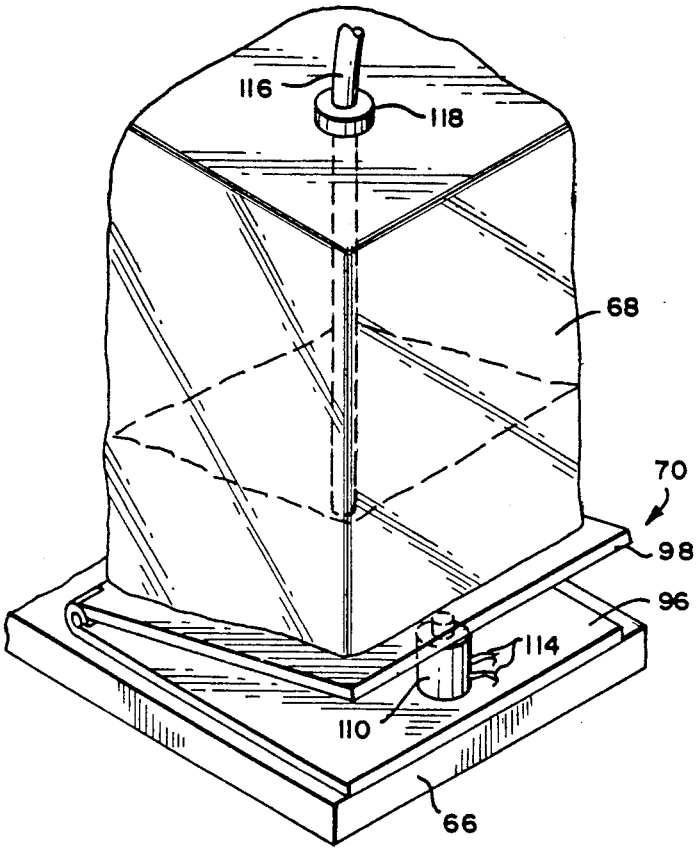
FIG. 4 is a fragmentary perspective view of the soap weigh mechanism of the invention.
Figure 5:
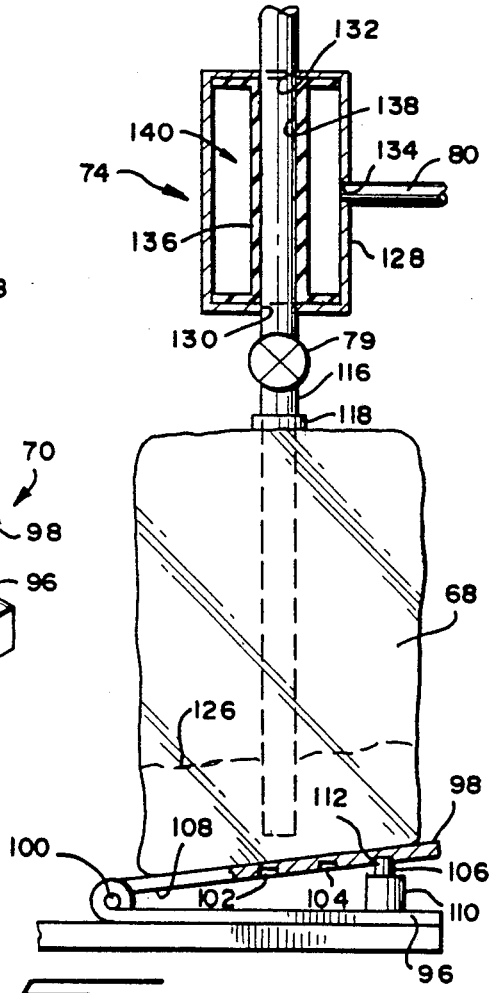
FIG. 5 is a fragmentary elevational view of the soap dispensing system of the invention, with portions shown in section.

Weigh apparatus 70, as best shown in FIGS. 4 and 5, comprises a first support plate 96 resting on support 66, and a second plate 98 overlying plate 96 and hingedly connected thereto by hinge assembly 100. Soap container 68, which, preferably, is a relatively lightweight disposable bottle, rests upon second plate 98. Second plate 98 has a plurality of recesses 102, 104 and 106 formed in surface 108 thereof in spaced relation relative to hinge assembly 100. Pressure switch 110 has a piston 112 selectively positionable in any one of recesses 102, 104 and 106. The weight of soap container 68, including the soap contents thereof, is thereby applied to the pressure switch 110 through piston 112 as a means for monitoring the degree of fullness of the container 68. Electric leads 114 extend from pressure switch 110 as a means for communicating with a central computer, such as shown in FIG. 12, the quantity of soap contained in the container 68.

I have found it desirable to provide flexibility in notifying the central computer when the soap container 68 requires replacement. The weight of the container 68 operating through the hinged assembly 70, exerts a force on the piston 112 which is proportional to the distance between the piston 112 and the hinge assembly 100. In this way, I can selectively position the pressure switch 110 and its piston 112 so that the pressure switch 110 is tripped when a selected quantity of soap remains in the container 68. In this way maintenance can be notified depending upon its response time. I prefer to use a pressure switch, which sends the appropriate signal only when it is tripped, because that minimizes the load on the central computer. Otherwise, the central computer would be required to periodically interrogate the switch 110 as a means for determining the quantity remaining in the container 68. Because the cleansing agent in the container will, most likely, only be slowly consumed, a pressure actuated switch is most feasible.

FIGS. 4 and 5 also disclose the continuous resilient fill tube 116 extending through pump 74 into soap container 68. I provide a sealing disk 118 at the top of container 68, in order to prevent spillage of soap, as well as to provide a frangible opening into which the tube 116 may be inserted. It is to be noted in FIG. 5, that the tube 116 extends through the pump 74. This means that the fill tube 116 must be changed when the container 6 is replaced. This minimizes the possibility of contamination occurring at joints or fittings. This is particularly appropriate in a hospital environment, where the possibility of infection should be avoided as much as possible. In a food-handling environment, however, this may not be as necessary.

Roll towel dispensing means 32, as best shown in FIGS. 2 and 3, has an infrared sensor 34, preferably of the passive type. The sensor 34 causes electric motor 120 to operate whenever a user requires toweling. This is particularly appropriate in a hospital environment, where a sudden emergency may preclude the user's completion of the normal wash cycle. Electric motor 120 causes roll 122 of paper towel to rotate by means of one-way transmission 124. This assures that toweling is dispensed through the opening in dispensing means 32, and prevents the roll 122 from being wound up.

I have found that a number of different types of pumps may be utilized in causing the cleansing material 126 to be pumped to faucet 20. For example, pinch valve pump 74 has an outer substantially non-deformable cylindrical casing 128 which is closed at the ends thereof, except for openings 130 and 132 which provide, respectively, an inlet and an outlet for tubing 116, as best shown in FIG. 5. A further opening 134 is formed in the side of casing 128 to permit a connection for water line 80.

Resilient bladder 136 is positioned within casing 128, and has a central opening 138 of continuous diameter through which tubing 116 extends. I prefer that the opening 138 be of a substantially continuous diameter corresponding to the diameter of the tubing 116, in order to provide a snug fit therewith. This snug fit maximizes the pumping force. Also, the tubing 116 can therefore be relatively thin, and the thickness thereof may be selected based upon the quantity of soap 126 which is to be pumped. The thicker the wall of tubing 116, then the smaller the volume of soap contained in the pumping chamber thereof.

Those skilled in the art will understand that the introduction of water through line 80 into the annular chamber 140 defined by bladder 136 and casing 128 will have the effect of causing the central opening 138 to be squeezed, thereby collapsing the tubing 116. This sudden collapse has the effect of causing the material contained within the tubing 116 to be forced outwardly. Check valve 78 permits the pumped soap to flow to faucet 20, while valve 79 prevents flow to container 68. This is a rapid pumping action, and causes the soap 126 to spurt from tubing 82.

The bladder 136 will remain in the expanded condition for so long as the valve 84 is opened. Once the valve 84 is closed, thereby removing the source of water pressure from line 88, then it is merely necessary to open the valve 90 to allow the water to bleed through to faucet 20 so that the central opening 138 will be expanded again. I prefer that the water released through valve 90 feed into the water flow channel 60. Also, because of the valves 78 and 79, the soap contained in line 80, after pumping has occurred, will not be drawn back into the pump 74, but will instead remain in the line until the next pumping cycle has occurred. Also, soap will be pulled from container 68 into pump 74.

Figure 8:
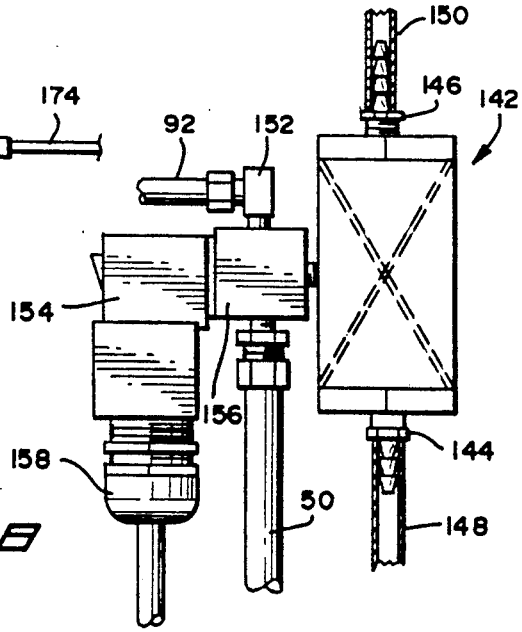
FIG. 8 is a fragmentary elevational view, with portions shown in section, of a further pump system.

Pinch valve pump 142, as best shown in FIG. 8, is similar to pump 74, with the exception that bayonet connections 144 and 146 are provided at the inlet and outlet thereof, respectively. Also, unlike the pump 74, the tube 148 which leads to the soap container 68 does not extend through the pump 142. Likewise, the tube 150 affixed to connector 146 leads to faucet 20. In this way, the central opening 138 of the bladder 136 itself forms the soap conduit. Naturally, check valves are provided before and after pump 142 in order to assure that soap flows to the pump 142 and then to faucet 20.

FIG. 8 discloses check valve 152, which is, preferably, a ball check valve, which feeds line 92 leading to faucet 20. Normally closed solenoid 154 operates control valve 156 at the discharge end of line 50. Electrical cable 158 supplies the operating power and control signal which causes the solenoid valve 154 to operate. The check valve 152 prevents water from flowing through line 92 into the valve 156, and is sized such that the sudden flow of water from line 50 is substantially diverted into pump 142. The check valve 152 thereby acts as an orifice, allowing the water to bleed once the valve 156 is closed by the solenoid 154.

Figure 6:
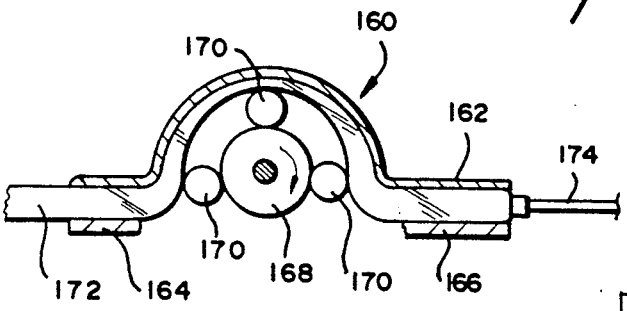
FIG. 6 is a fragmentary elevational view of yet a further means for dispensing soap.

FIG. 6 discloses an electrically operated rotary peristaltic pump which is also useable for causing the cleansing material 126 to be pumped to the faucet 20. The pump 160 has a removable cover 162 overlying supports 164 and 166. Central shaft 168 is rotated by an electric motor (not shown). Shaft 168 carries fingers 170 along the periphery thereof, for engagement with resilient soap supply conduit 172. Conduit 172 feeds soap line 174 leading to faucet 20.

Rotation of shaft 168 causes the fingers 170 to selectively engage the conduit 172, thereby causing same to be compressed against the cover 162. This is a rolling type of motion, having the tendency of forcing the soap toward soap line 174 as rotation continues.

The cover 162 is removable from its overlying relation to the shaft 168 and supports 164 and 166, thereby facilitating replacement of the soap conduit 172 as the soap is consumed in the container 68. As with the soap pump 74, replacement of the soap conduit 172, after the soap in the container 68 has been consumed, is an effective means of minimizing contamination which might find its situs at a fitting. It should be appreciated that the soap container and conduit may be an integral unit, thereby facilitating replacement.

As earlier noted, push button selector switch 22 is mounted to upper surface 16 of cabinet 10 adjacent faucet 20. The selector switch 22 is a two position switch. I have found that there are occasions when a user may merely desire water, such as for drinking. In such instance, the selector switch 22 is an effective means for permitting only water to be dispensed from the faucet 20. As noted, roll toweling is available from the dispenser 32 at all times because of the second sensor 34. Display 38 will not be operated when the push button switch 22 is in the water only position, because the display 38 is operated by controller 176, and is only advanced when soap is pumped.

All electrical controls for the wash station W1 reside in the electronic controller 176, which is positioned within cabinet 10. The controller 176 may be hardwired, or may be a programmable controller. The controller 176 has the functions of receiving all required electrical signals from the sensor 18, the push button 22, and the pressure switch 114, as well as for causing appropriate output signals to the display 38, and the solenoid-operated valves 52, 54, 84, 90 and 78. The central controller 176 will, preferably, communicate with a host computer.

Figure 9:
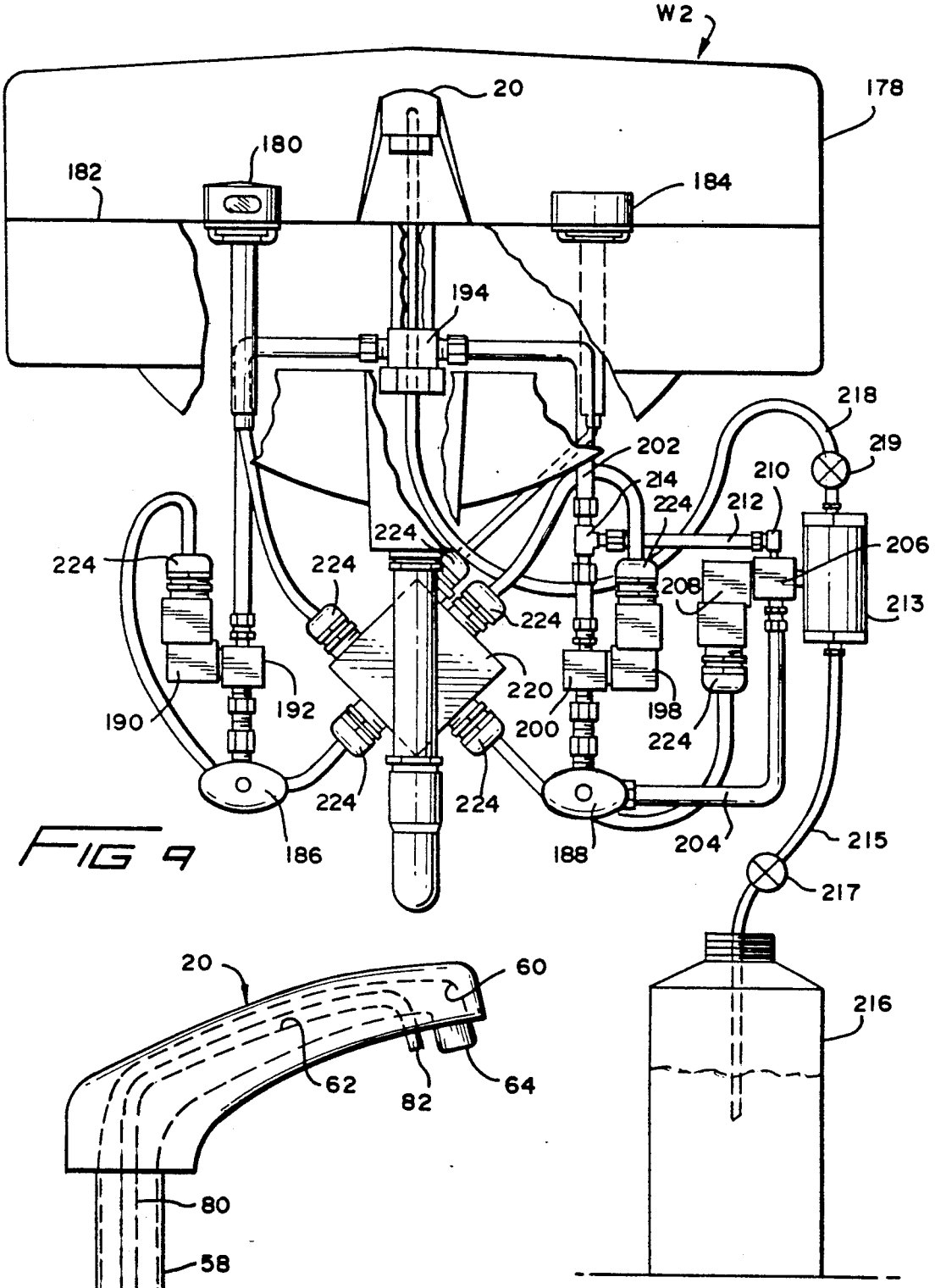
FIG. 9 is an elevational view with portions broken away of yet a further embodiment of the wash station of the invention.

FIG. 9 discloses wash station W2. Wash station W2 may be adapted for use with a sink 178 which is of conventional design. A first infrared sensor 180, which is, preferably, of the active type, is mounted to surface 182 of sink 178 and is used for determining the presence of the hands of a user beneath faucet 20. The faucet 20 of wash station W2 is substantially the same as the faucet 20 of wash station W1, and no further discussion thereof is seen to be necessary.

Also mounted to surface 182 is second sensor 184, which is also of the active type. The sensor 184 looks upwardly, however, as opposed to the sensor 180 which looks horizontally. In this way, the eye of the sensor 180 may be thought of as operating on a horizontal plane, while the eye of the sensor 184 operates on a vertical plane extending substantially transverse to the plane of the sensor 180. This relationship avoids possible confusion to the controller 176 on account of inaccurate positioning of the hands of a user.

Wash station W2 has manual water supply valves 186 and 188 providing a source of pressurized water to the wash station W2. Normally closed solenoid 190 operates control valve 192 for causing water to selectively flow to T-connector 194 through line 196. Similarly, normally closed solenoid 198 operates control valve 200 for permitting water to flow through line 202 to T-connector 194. Line 204 likewise leads from manually operated valve 188 to control valve 206. Valve 206 is operated by normally closed solenoid 208. Check valve 210 feeds line 212 which communicates with line 202 through T-connector 214. Pump 213, which is substantially the same as the pump 142 of FIG. 8, has soap supply line 215 leading from soap container 216. Soap line 218 extends from the outlet of pump 142 to conduit 80. Naturally, check valves 217 and 219, which may be ball check valves, are interposed between container 216 and faucet 20 in order to control pumping of the soap.

Control box 220 is mounted to a vertical support behind drain 222. Electric lines extend from the control box 220 to each of the pieces of equipment, and preferably the lines have strain relieving plug assemblies 224 to minimize deterioration of the electrical cable.

I have found that the sensor 184 is preferable to the push button 22, particularly in hospital environments. The sensor 184, by looking upwardly, need not be contacted by the user, thereby minimizing the risk of infection due to prior contact. Instead, in order to have the control box 220 switch the wash station W2 between the automatic and normal modes, it is merely necessary for the user to place his or her hand over the sensor 184 for a sufficient period of time. I have found that a sense time of approximately three seconds is sufficient, and avoids unintended tripping which could occur if a hand was moved rapidly across the scan zone of the sensor 184. Also, I prefer that tripping of the sensor 180 be required within a selected time upon the wash station W2 being set in the wash mode by the sensor 184. This is a further means of assuring that unintended operation does not occur. In other words, first put the wash station in the hand wash mode, and then put the hands under the faucet.

FIG. 12 discloses a schematic diagram by which the wash stations W1 and W2 are connected to a host or central computer. The control unit, which corresponds to the controller 176 of the wash station W1, operates both the display 38 and the soap weighing mechanism 70. Also, the control unit feeds relevant operating information to the central computer which, if necessary, notifies maintenance of the need to take action with regard to the relevant wash station. The display 38 and the soap weighing mechanism 70 likewise communicate with the central computer, through the controller 176, as may be desired. This permits the central computer to periodically query the display and the soap weigher in order to monitor usage of the wash station.

Figure 10:
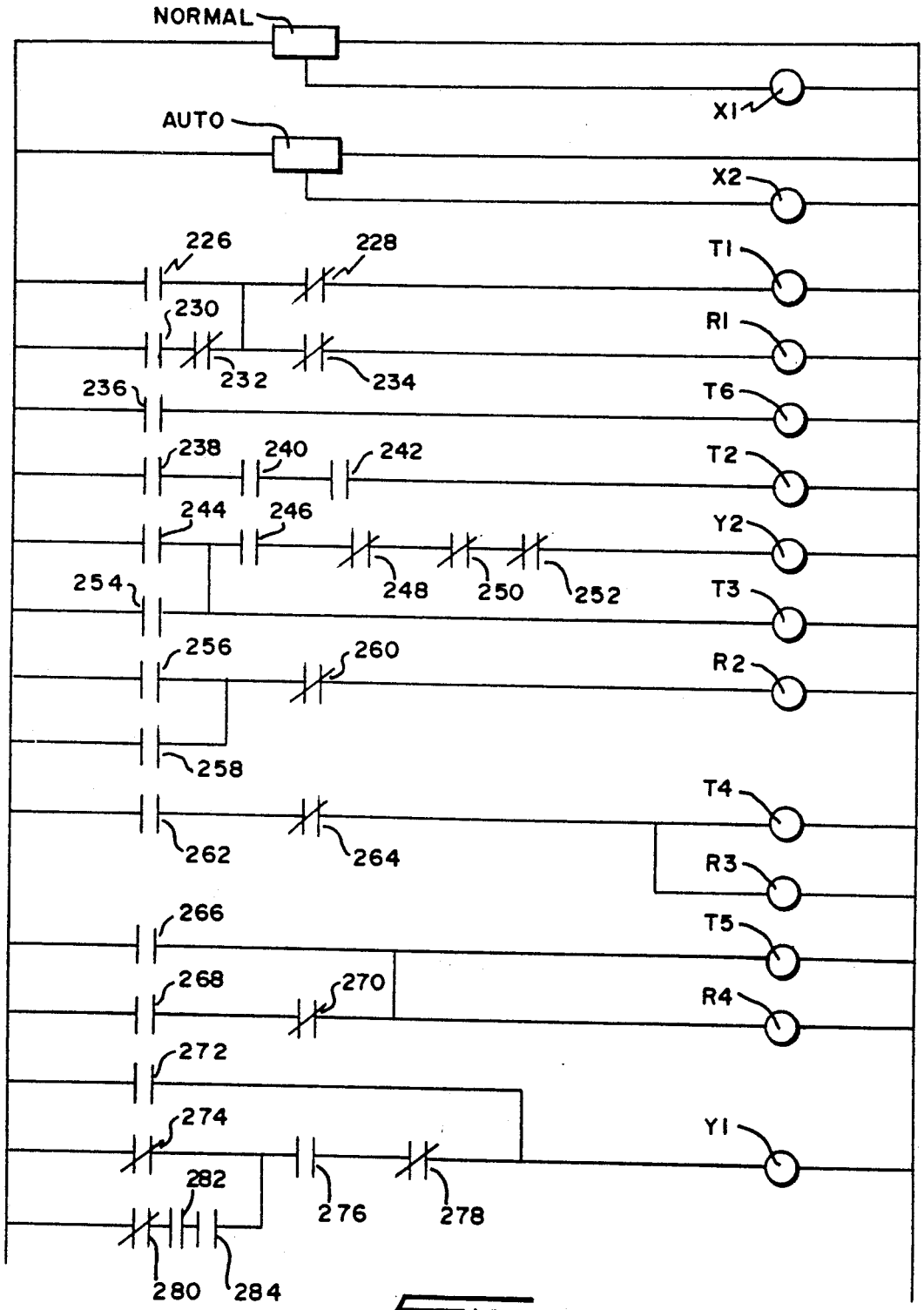

FIGS. 10 and 11 disclose the wiring diagram by which the wash stations W1 and W2 are constructed. Those skilled in the art will appreciate that the wiring diagram of FIGS. 10 and 11 may be assembled by hard wiring, or may be achieved through software control, such as with a programmable controller.

The box "Normal" indicates the condition which the wash stations W1 and W2 are normally in, and water only is dispensed when in this mode. In the normal mode, relay or output X1 is energized. Should the automatic, or soap dispensing mode, be desired, then the "auto" box causes relay or output X2 to be energized.

Normally open contacts 226 of timer T6 must be closed for current to feed through the normal closed contacts 228 of relay R4 to timer T1. This provides a reset feature, so that if a potential user puts the system into automatic, then the user must make some motion in the view field of sensor 18 within a selected time as set by timer T1. Should nothing occur during the 40 second period, then timer T1 runs out, thereby resetting the control system to the normal mode. The reset is only necessary when in the automatic mode.

Normally open contacts 230 of relay R1 are closed during the time that timer T1 is running, thereby providing a holding circuit because the contacts 232 of the timer T1 are normally closed, as are the contacts 234 of relay R4. The contacts 230 are internal to the relay R1, and cause a constant control signal to be applied, since the timer T1 will only supply a control signal upon the expiration of the allotted time.

The normally open contacts 236 of the relay X2 cause timer T6 to be operated. Timer T6 is the timer which determines when the user has placed his or her hand over the sensor 184 for a sufficiently long period. I have found that approximately three seconds are sufficient to make certain that the user wishes to switch the wash station W2 to the auto mode. Of course, this time function need not be present if the pushbutton selector switch 22 is utilized.

Normally open contacts 238 of relay R1, 240 of relay X1 and 242 of timer T0 control operation of timer T2. Timer T0 provides a one second pause, which is desired in order to give the user sufficient time to place his or her hands under the faucet 20. Once the timer T0 times out, then timer T2 causes a 0.1 second spurt of water to flow to the faucet 20 by operation of the valves 52 and 54 or 192 and 198, depending upon the wash station being used. This spurt of water is sufficient to wet the hands.

Normally open contacts 244 are internal to relay T2. The contacts 244 lead to normally open contacts 246 which are internal to relay X1. The contacts 246 feed normally closed contacts 248 which are internal to timer T3. The contacts 248 feed normally closed contacts 250 which are internal to relay R3. Contacts 250 feed normally closed contacts 252 which are internal to relay R4. The contacts 252 cause relay Y2 to operate. The relay Y2 energizes the pump 160, or causes operation of pump solenoids 84 or 206.

Normally open contacts 254 are internal to relay Y2, and feed timer T3. The timer T3 is, preferably, set for approximately four seconds in order to provide adequate soap from the pump. Should pinch valve pumps 74 or 142 be utilized, then the time need not be as long as four seconds.

Normally open contacts 256 are internal to relay Y2. Likewise, normally open contacts 258 are internal to relay R2. The contacts 256 and 258 feed normally closed contacts 260 which are internal to timer T4. The contacts 260 feed relay R2 and provide a hold circuit for that period of time between initiation of timer T3 and its termination.

Normally open contacts 262 are internal to relay R2 and feed normally closed contacts 264 which are internal to relay Y2. The contacts 264 feed timer T4 and the hold-in relay R3. I have found that the time T4 should be set for approximately 15 seconds, and this provides sufficient time for the user to lather his or her hands after the soap has been pumped. During this waiting period, water is not permitted to flow to the faucet 20. Normally open contacts 266 are internal to relay T4, and feed timer T5. Likewise, normally open contacts 268 are internal to relay R4, and feed normally closed contacts 270 which are internal to timer T5. Activation of timer T5, along with the hold-in circuit provided by the relay R4, cause water to be dispensed from the faucet 20 for a period of five seconds. I have found that operation of the solenoid valves 52 and 54, or 192 and 198, for a period of five seconds is sufficient to wash the lathered soap from the hands of the user.

Normally open contacts 272 are internal to relay R4, and feed relay Y1 which controls the water solenoid 52 and 54, or 192 and 198. Likewise, normally closed contacts 274 are internal to relay R1, and feed normally open contacts 276 of relay X1. Contacts 276 feed the normally closed contacts 278 of relay R3. The normally closed contacts 280 of timer T2 feed the normally open contacts 282 of the timer T0. The contacts 282 feed the normally open contacts 284 of the relay R1.

As noted, I provide timer T0 in order to assure sufficient time for the user to place his or her hands under the faucet 20. The timer T0 is controlled by the normally open contacts 286 of relay R1, as well as the contacts 288 and 290 of, respectively, relay X1 and timer T0.

Normally open contacts 292 of relay R62 cause operation of relay Y0. The relay Y0 controls operation of the motor 120 of roll towel dispenser 32. This assures that toweling is always available, regardless of what other function the wash station may the be performing.

The normally open contacts 294 of relay X1 operate relay R60, and assure that toweling is dispensed, when in the normal mode, only when the user has taken his or her hand away from the sensor 34. I have found that there can be occasions when some article or the like may mistakenly actuate sensor 34. This can be avoided if the motor is only permitted to operate after the detected "person" has moved his or her hand away from the sensor 34. Otherwise, if the hand is not moved, then toweling will not be dispensed.

The normally open contacts 296 of relay R60 feed the normally closed contacts 298 of the relay R62. Likewise, the normally open contacts 300 of the relay R61 feed the contacts 298.

The normally open contacts 302 of the relay R61 feed the normally closed contacts 304 of the relay R60. The contacts 304 feed the normally closed contacts 306 of the relay R4. The contacts 306 feed relay R62 and timer T7. Likewise, the normally open contacts 308 of relay R62 feed the normally closed contacts 310 of the timer T7. The contacts 310 feed the contacts 306. This assures that a predetermined length of toweling is dispensed from the dispenser 32, because the motor 120 is caused to operate for a predetermined time.

OPERATION

Operation of the wash stations W1 and W2 is essentially automatic, because of the sensors 18 and 180, as well as the selector switches 22 and 184. It is merely necessary that the user approach the wash station, and then take the desired action, whether requesting washing or water, or merely requesting that toweling be dispensed.

The wash stations W1 and W2 are normally in the "normal" mode, meaning that a user will only cause water to be dispensed from the faucet 20 when his or her hands are placed under the faucet 20, and thereby in the detection zone of the sensors 18 or 180. In that event, then the contacts 274, 276 and 278 assure that the water continues to flow for so long as the hands or object, such as a pitcher, are under the spout. Should the user take his or her hands away, then the contacts 280, 282 and 284 and timer T0 cause the water to continue to flow for one second after the hands have been removed. I have found this delay desirable, because it is not unusual for a user to unintendedly remove his or her hands from the detection zone of the sensors 18 or 180. The delay period, therefore, prohibits rapid cycling of the control valves 52 and 54 or 192 and 198. This minimizes wear on the system, without wasting much water.

Should the user desire that toweling be dispensed from the dispenser 32, then it is merely necessary that he or she place a hand in front of the sensor 34 and then remove same. This causes initiation of the motor 120, for a period set by the timer T7. Any diminishment in length due to changes in the diameter of the roll 122 are fairly minimal.

Should the user desire to use the wash station for washing of the hands, then this may be accomplished easily. It is merely necessary that the push button 22 be pressed, or that the user place his or her hand over the sensor 184 for the required period. Once a hand has been placed over the sensor 184 for the desired time, then the controller 176 places the wash station into the automatic mode.

Once in the automatic mode, then it is necessary that the user place his or her hands under the faucet 20 within the detection zone of the sensors 18 or 180 for the period specified by timer T1. This assures that the user does not put the wash station into the automatic mode, and then walk away. Should that event occur, then timing out of the timer T1 causes the system to reset to the normal mode.

Assuming that the user places his or her hands within the target zone of the sensors 18 or 180, then the solenoid operated valves 52 and 54, or 192 and 198, are caused to operate for supplying sufficient water to permit the hands to be wet. Most cleansing agents are water soluble, and that it is desired, as with normal hand washing, that the hands be wet prior to application of the liquid soap. This does not require much water, and only enough to wet the hands is necessary.

Once the hands have been wet, then the controller 76 causes soap to be pumped by operation of any of the pumps 74, 142 or 160. I can control the quantity of soap which is pumped by either regulating the thickness of the tubing within the central opening 136 of the pumps 74 or 142, or else by regulating the pumping time of the peristaltic pump 160. Those skilled in the art understand that insufficient soap is undesirable, but equally as undesirable is too much soap. Regulation of the pumping volume is therefore an appropriate means for assuring an adequate amount of soap, based upon the particular soap being used.

Once the soap has been pumped, then no water is permitted to flow to the faucet 20 for the period specified by timer T4. I have found that 15 seconds are sufficient for the typical user to thoroughly lather his or her hands. Once lathering has occurred, as noted by the timer T4, then the timer T5 causes five seconds of water to be dispensed. This is a sufficient quantity to rinse the soap from the hands.

Operation of the solenoid valves 52 and 54 or 192 and 198 for dispensing rinse water causes relay R62 to be energized, thereby causing timer T7 to activate so that toweling is dispensed for the selected period. The user may then tear the toweling from the dispenser 32, and dry his or her hands. In this way, the user is not required to came into contact with any part of the wash station W1 or W2 after the hands have been cleansed. Therefore, the spread of infection is minimized, because the wash stations W1 and W2 assure proper cleaning of the hands.

While this invention has been described as having a preferred design, it is understood that it is capable of further uses, modifications and/or adaptations as come within known or customary practice in the art to which the invention pertains, and as may be applied to the central features hereinbefore set forth, and fall within the scope of the invention and the limits of the appended claims.

What I claim is:

1. A wash station, comprising:

a) receptacle means for receiving fluids;

b) a source of water;

c) a source of cleansing means;

d) first means interposed between said water source and said receptacle means for selectively supplying water thereto, and second means interposed between said cleansing means source and said receptacle means for selectively supplying cleansing means;

e) towel dispensing means proximate said receptacle for dispensing a length of continuous roll towel means;

f) first sensor means operatively associated with said receptacle means for determining the presence of a user; and, g) electronic control means operatively associated with said first and second means, said towel dispensing means, and said sensor means for electronically and selectively causing a supply of water and cleansing mans to be supplied to said receptacle means and for thereafter causing a length of roll towel means to be dispensed.

2. The wash station of claim 1, wherein:

a) means being operably associated with said source of cleansing means for determining the quantity of cleansing means in said source.

3. The wash station of claim 2, wherein:

a) said source of cleansing means includes a bottle in which the cleansing means is contained; and, b) said determining means being disposed below and engaged with said bottle.

4. The wash station of claim 3, wherein:

a) said determining means comprising a pressure actuated switch.

5. The wash station of claim 3, wherein said determining means includes:

a) first and second hingedly connected members, said first member overlying said second member; and, b) a pressure actuated switch being disposed between said members so that the weight of the bottle is applied to said switch while resting on said first member.

6. The wash station of claim 1, wherein said second means includes:

a) pump means having an inlet communicating with said source of cleansing means, and an outlet communicating with said receptacle means.

7. The wash station of claim 6, wherein:

a) said pump means having a continuous resilient conduit interconnecting said inlet and said outlet, and said conduit being removable from said pump means.

8. The wash station of claim 6, wherein said pump means includes:

a) an outer substantially non-deformable shell having an opening therein;

b) a resilient bladder positioned within said shell, said bladder having a central opening aligned with said inlet and said outlet and an annular chamber communicating with said shell opening;

c) means interconnecting said shell opening and said source of water; and, d) valve means operably associated with said interconnecting means cooperating with said control means so that water is selectively introduced into said annular chamber for causing said chamber to expand and thereby said central opening to be collapsed so that cleansing means contained within said central opening is caused to be dispensed to said receptacle means.

9. The wash station of claim 8, wherein:

a) a resilient continuous conduit extending through said central opening between said inlet and said outlet, said conduit being removable from said central opening.

10. The wash station of claim 9, wherein:

a) said conduit extending between said source of cleansing means and said receptacle.

11. The wash station of claim 1, further comprising:

a) selector switch means being operably connected with said control means, said selector switch means having first and second positions so that said control means prohibits the supply of cleansing means to said receptacle means when said selector switch means is in said first position.

12. The wash station of claim 1, further comprising:

a) second sensor means being operably associated with said source of continuous roll towel means and with said control means; and, b) said control means including means causing toweling to be dispensed when said second sensor means has detected the presence of a user.

13. The wash station of claim 1, wherein:

a) counter means being operably associated with said control means for monitoring use thereof.

14. The wash station of claim 1, wherein said receptacle means includes:

a) a faucet having first and second flow channels;

b) said first flow channel being in fluid communication with said first means, and said second flow channel being in fluid communication with said second means.

15. The wash station of claim 7, wherein said pump means includes:

a) a motor driven rotary pump having a rotating shaft carrying a plurality of vanes;

b) a removable cover surrounding said shaft; and, c) said conduit being disposed between said cover and said vanes, so that rotation of said shaft causes said vanes to cyclicly engage and compress said conduit.

16. The wash station of claim 14, wherein:

a) said second flow channel being surrounded by said first flow channel.

17. A wash station, comprising:

a) a support assembly comprising a lower cabinet having an interior and an upper vertical structure;

b) a motor operated roll towel dispensing means mounted to said upper member, and a roll of toweling being operatively disposed within said dispenser;

c) a sink mounted to said cabinet below said dispensing means;

d) a faucet mounted to said cabinet and extending over said sink, said faucet having first and second flow channels discharging into said sink;

e) a source of water mounted within said cabinet;

f) a supply of soap disposed within said cabinet;

g) first means interconnecting said source and one of said flow channels for permitting water to selectively flow to said faucet, and second means interconnecting said supply and the other of said flow channels for causing soap to be supplied to said faucet;

h) sensor means operatively associated with said assembly for detecting the presence of a user; and, i) electronic control means operatively associated with said dispensing means, said first and second means, and said sensor means for electronically causing soap and water to be selectively supplied to said faucet and for thereafter causing a length of toweling to be dispensed.

18. The wash station of claim 17, wherein:

a) counter means being operatively associated with said control means so that usage thereof may be monitored.

19. The wash station of claim 17, wherein:

a) said second means including a pump for supplying a predetermined quantity of soap to said faucet.

20. The wash station of claim 19, wherein said pump includes:

a) a cylindrical shell comprised of a substantially rigid material, said shell being closed at the ends thereof and each end having an opening therein providing an inlet and an outlet and an aperture being disposed in said shell intermediate said inlet and outlet;

b) a resilient bladder disposed within said shell, said bladder having a central passage aligned with said inlet and said outlet and an annular chamber in communication with said aperture; and, c) means interconnecting said aperture with said source for causing water to be selectively supplied to said chamber so that said chamber expands and thereby causes said central passage to be collapsed and soap is thereby caused to be forced from said central passage to said faucet.

21. The wash station of claim 20, wherein:

a) a resilient conduit being positioned within and extending from said central passage for providing a continuous flow path for the soap, said conduit being removable from said central passage.

22. The wash station of claim 17, wherein:

a) means being operably associated with said supply for monitoring the amount of soap therein.

23. The wash station of claim 22, wherein:

a) said monitoring means including a switch disposed below and engaged with said supply.

24. The wash station of claim 17, wherein:

a) a selector switch being mounted to said assembly and being operably connected to said control means; and, b) said switch having first and second positions, so that supply of soap to said faucet is prohibited when said switch is in said first position.

25. The wash station of claim 24, wherein:

a) said faucet being disposed intermediate said sensor means and said selector switch.

26. The wash station of claim 24, wherein:

a) said sensor means and said selector switch being infrared sensors.

27. The wash station of claim 26, wherein:

a) said sensor means being oriented along a first plane and said selector switch being oriented along a second plane generally transverse to said first plane.

28. The wash station of claim 16, wherein:

a) one of said flow channels being surrounded by the other of said flow channels.

* * * * *